US005727844A

United States Patent [19]

O'Quinn et al.

[11] Patent Number: 5,727,844

[45] Date of Patent: Mar. 17, 1998

[54] COOLER AND SEAT SYSTEM

[76] Inventors: Jeffrey Lee O'Quinn; James Lee O'Quinn, both of 823 Cherry Hills La., Lebanon, Mo. 65536

[21] Appl. No.: 803,426

[22] Filed: Feb. 20, 1997

[51] Int. Cl.[6] ..... A47C 31/00; A47C 7/62

[52] U.S. Cl. ..... 297/217.1; 297/188.1; 297/188.13; 297/188.09; 206/216; 206/545; 220/212

[58] Field of Search ..... 297/188.08, 188.09, 297/188.1, 188.13, 217.1, 380; 206/545, 541, 546, 216, 234, 372, 373; 220/212; 248/455, 460, 461

[56] References Cited

U.S. PATENT DOCUMENTS

| | | | |
|---|---|---|---|
| D. 330,639 | 11/1992 | Munro et al. | 297/188.1 |
| 1,156,367 | 10/1915 | Masler | 297/188.13 |
| 1,767,925 | 6/1930 | Hargreaves | 297/188.1 |
| 1,813,793 | 7/1931 | Bullock | 248/455 |
| 2,555,126 | 5/1951 | Greve | 206/216 |
| 2,812,227 | 11/1957 | Hill | 297/188.1 |
| 4,773,709 | 9/1988 | Slinkard | 297/188.09 |
| 5,269,157 | 12/1993 | Ciminelli et al. | 297/188.1 |

*Primary Examiner*—Peter M. Cuomo
*Assistant Examiner*—Anthony D. Barfield

[57] ABSTRACT

A cooler and seat system including an insulated container that has a rectangular bottom member with a rectangular rear wall, a rectangular front wall and a pair of side walls. The insulated container has an upper peripheral edge therearound and integral the walls. A first lid has a bottom portion and a top portion with a peripheral wall therebetween and hingedly coupled to the rear wall of the insulated container. A second lid has a bottom portion and a top portion with a peripheral wall therebetween. The peripheral wall is hingedly coupled to the peripheral wall of the first lid for selective rotation of the second lid thereabout. The first lid, when coupled with the second lid, is capable of forming a seat. Lastly, a pair of anti-extension straps with each having a first end coupled to the first lid and a second end coupled to the second lid.

1 Claim, 3 Drawing Sheets

COOLER AND SEAT SYSTEM

BACKGROUND OF THE INVENTION

1. Field of the Invention

The present invention relates to a cooler and seat system and more particularly pertains to providing a cooler with a dual lid that converts to a seat having a backrest for use on outings.

2. Description of the Prior Art

The use of a seat cooler is known in the prior art. More specifically, Seat coolers heretofore devised and utilized for the purpose of keeping food cold while providing a seat are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,435,642 to Kennedy discloses a combined cooler-seat sports gear. U.S. Pat. No. 5,100,198 to Baltzell discloses a seat cooler apparatus. Des. U.S. Pat. No. 330,639 to Munro and Birner discloses a seat with cooler compartment. U.S. Pat. No. 4,632,048 to Nazar discloses a portable adjustable chair with insulated seat cooler. U.S. Pat. No. 4,191,420 to Fassett and Norris discloses a portable chair and storage unit. Lastly, Des. U.S. Pat. No. 247,152 to Rayfield discloses a combined carrier cooler and seat.

While these devices fulfill their respective, particular objectives and requirements, the aforementioned patents do not describe cooler and seat system that allows persons attending sporting or recreational events to carry food in the cooler and use the dual lid as a seat with a back rest.

In this respect, the Cooler and seat system according to the present invention substantially departs from the conventional concepts and designs of the prior art, and in doing so provides an apparatus primarily developed for the purpose of providing a cooler with a dual lid that converts to a seat having a backrest for use on outings.

Therefore, it can be appreciated that there exists a continuing need for a new and improved Cooler and seat system which can be used for providing a cooler with a dual lid that converts to a seat having a backrest for use on outings. In this regard, the present invention substantially fulfills this need.

SUMMARY OF THE INVENTION

In view of the foregoing disadvantages inherent in the known types of seat coolers now present in the prior art, the present invention provides an improved Cooler and seat system. As such, the general purpose of the present invention, which will be described subsequently in greater detail, is to provide a new and improved cooler and seat system and method which has all the advantages of the prior art and none of the disadvantages.

To attain this, the present invention essentially comprises an insulated container. The container has a rectangular bottom member with a rectangular rear wall, a rectangular front wall and a pair of side walls extending upwardly therefrom. The pair of side walls form a first side wall and a second side wall, with each integral with and perpendicular the rear and front walls. Each side wall has a handle rotatable coupled. The second side wall has a drain passing therethrough. The insulated container has an upper peripheral edge therearound and integral the walls. The insulated container has interior walls that are integral with the upper peripheral edge. Also, a first lid is provided and formed of insulated material. The first lid has bottom portion and a top portion with a peripheral wall therebetween. The peripheral wall forms a pair of first side walls with a first rear wall and a first front wall therebetween. The first rear side wall is hingedly coupled to the rear wall of the insulated container for selective opening and closing of the insulated container. The top portion of the first lid has a cushion member fixedly attached. The bottom portion of the first lid is flush with the upper peripheral edge of the insulated container when parallel the insulated container for closure. Included is a second lid formed of insulated material. The second lid has a bottom portion and a top portion with a peripheral wall therebetween. The peripheral wall forms a pair of second side walls with a second rear wall and a second front wall. The second rear wall is hingedly coupled to the first rear wall of the first lid for selective rotation of the second lid thereabout. The bottom portion of the second lid has a cushion member fixedly attached. The second lid is capable of coupling with the first lid when the first lid is rotated for opening the insulated container. The bottom portion of the second lid is flush with the top portion of the first lid, when the first and second lid is in a juxtapose orientation. The first lid, when coupled with the second lid, is capable of forming a seat with the first lid functioning as the bottom and the second lid functioning as the back rest. A pair of anti-extension straps are provided. Each strap has a first end coupled to the first lid and a second end coupled to the second lid. The pair of anti-extension straps support the second lid in an upright position, when the first lid is flush the upper peripheral edge of the insulated container. Lastly, a pair of supports are provided. Each support has a back end edge and a front end edge with a top and bottom edge therebetween. The back end edge is hingedly coupled with the rear wall of the insulated container. The pair of supports are rotatable from a closed position to an open position along the rear wall of the insulated container. The pair of supports, when in an open position, are capable of balancing the insulated container when a person is seated on the first lid and resting against the second lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cooler and seat system which has all of the advantages of the prior art seat coolers and none of the disadvantages.

It is another object of the present invention to provide a new and improved cooler and seat system which may be easily and efficiently manufactured and marketed.

It is further object of the present invention to provide a new and improved cooler and seat system which is of durable and reliable constructions.

An even further object of the present invention is to provide a new and improved cooler and seat system which is susceptible of a low cost of manufacture with regard to both materials and labor, and which accordingly is then susceptible of low prices of sale to the consuming public, thereby making such cooler and seat system economically available to the buying public.

Even still another object of the present invention is to provide a cooler and seat system for providing a cooler with a dual lid that converts to a seat having a backrest for use on outings.

Lastly, it is an object of the present invention to provide a new and improved cooler and seat system including an insulated container that has a rectangular bottom member with a rectangular rear wall, a rectangular front wall and a pair of side walls. The insulated container has an upper peripheral edge therearound and integral the walls. A first lid has a bottom portion and a top portion with a peripheral wall therebetween and hingedly coupled to the rear wall of the insulated container. A second lid has a bottom portion and a top portion with a peripheral wall therebetween. The peripheral wall is hingedly coupled to the peripheral wall of the first lid for selective rotation of the second lid thereabout. The first lid, when coupled with the second lid, is capable of forming a seat. Lastly, a pair of anti-extension straps with each having a first end coupled to the first lid and a second end coupled to the second lid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
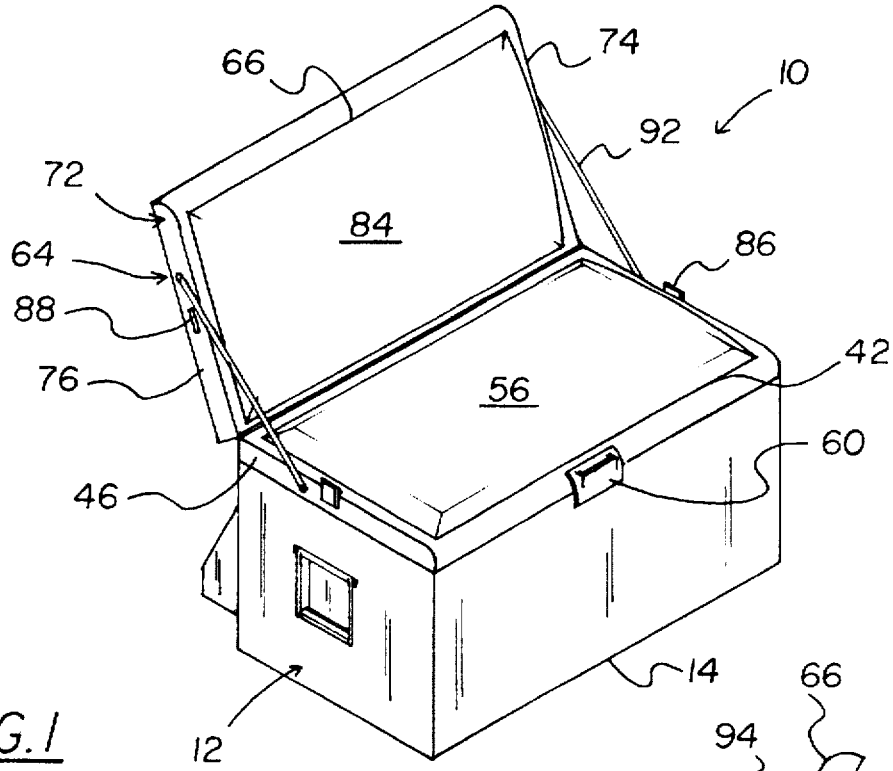
FIG. 1 a perspective view of the preferred embodiment of the cooler and seat system constructed in accordance with the principles of the present invention.

With reference now to the drawings, and in particular to FIG. 1 thereof, the preferred embodiment of the new and improved cooler and seat system embodying the principles and concepts of the present invention and generally designated by the reference numeral 10 will be described.

The present invention, the Cooler and seat system 10 is comprised of a plurality of components. Such components in their broadest context include an insulated container, a pair of lids and a pair of supports. Such components are individually configured and correlated with respect to each other so as to attain the desired objective.

Figure 3:
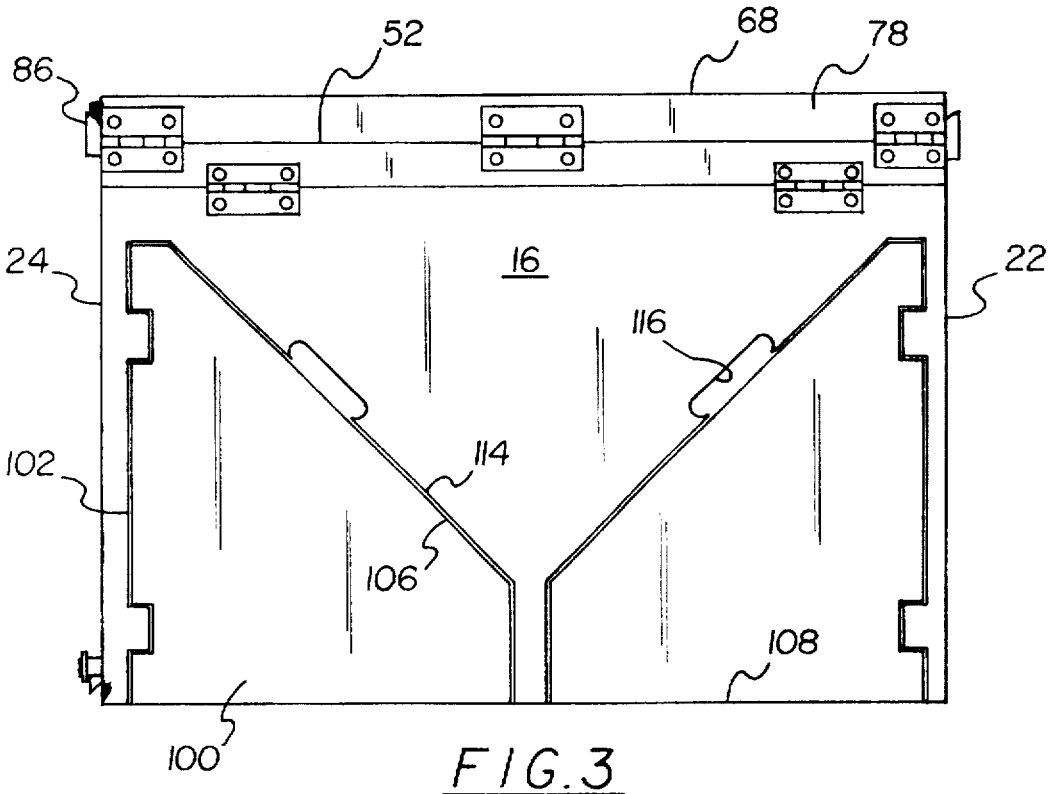
FIG. 3 is a rear view of the cooler and seat system and showing the supports.
Figure 4:
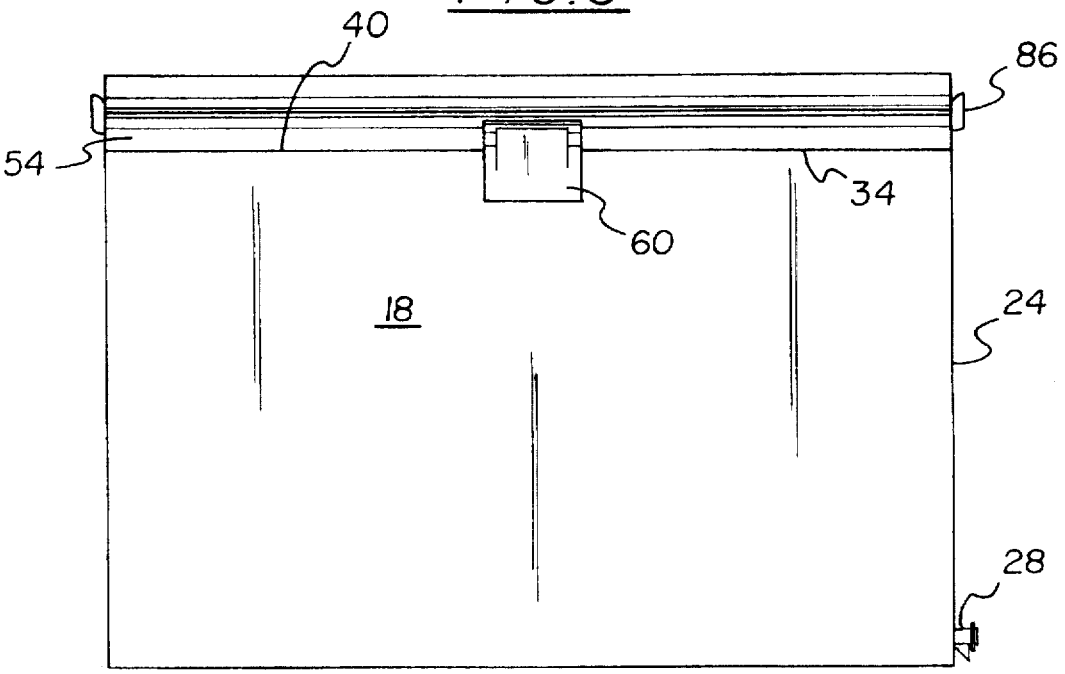
FIG. 4 is a frontal view of the cooler and seat system of the present invention.
Figure 6:
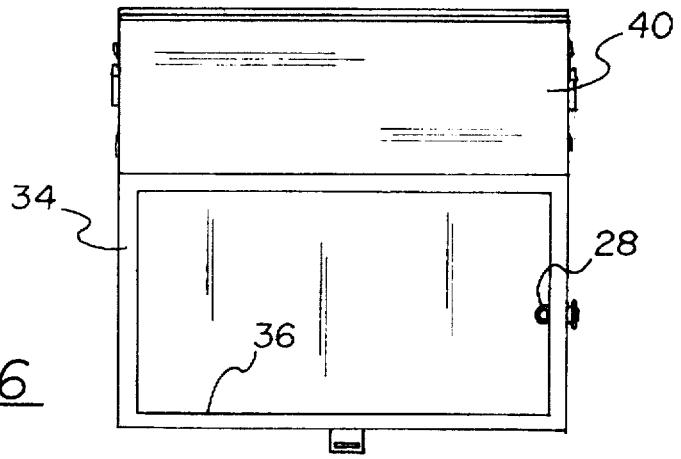
FIG. 6 is a top plan view of the present invention showing the dual lid in an open orientation.

Specifically, the present invention includes an insulated container 12. The insulated container has a rectangular bottom member 14 with a rectangular rear wall 16, a rectangular front wall 18 and a pair of side walls 22 and 24. The walls extend upwardly from the bottom member. As seen in FIGS. 3 and 4, the pair of side walls form a first side wall 22 and a second side wall 24 integral with and perpendicular the rear and front walls. Each side wall has a handle 26 that is rotatable coupled to the applicable side wall. The second side wall has a drain 28, as shown in FIG. 6, that passes through the second side wall. The drain is a push and pull plug that can be opened and closed as needed for release of liquid within the container. The insulated container has an upper peripheral edge 34 therearound and integral the walls. The insulated container has interior walls 36 that are integral with the upper peripheral edge.

As best illustrated in FIG. 1, a first lid 38 formed of insulated material is provided. The first lid has a bottom portion 40 and a top portion 42 with a peripheral wall 44. The peripheral wall forms a pair of first side walls 46 and 48 with a first rear wall 52 and a first front wall 54 therebetween. As shown in FIG. 3, the first rear side wall is hingedly coupled to the rear wall 16 of the insulated container 12 for selective opening and closing of the insulated container. The top portion of the first lid has a cushion member 56 fixedly attached. The bottom portion of the first lid, as seen in FIG. 4, is flush with the upper peripheral edge 34 of the insulated container when parallel the insulated container for closure of the container. When the first lid is closed over the container food or beverages are kept cool for later consumption. A clasp 60 is attached to the front wall of the insulated container. The clasp is metal or plastic. When the first lid is flush with the upper peripheral edge of the insulated container, the clasp locks the first lid firmly in position.

Figure 2:
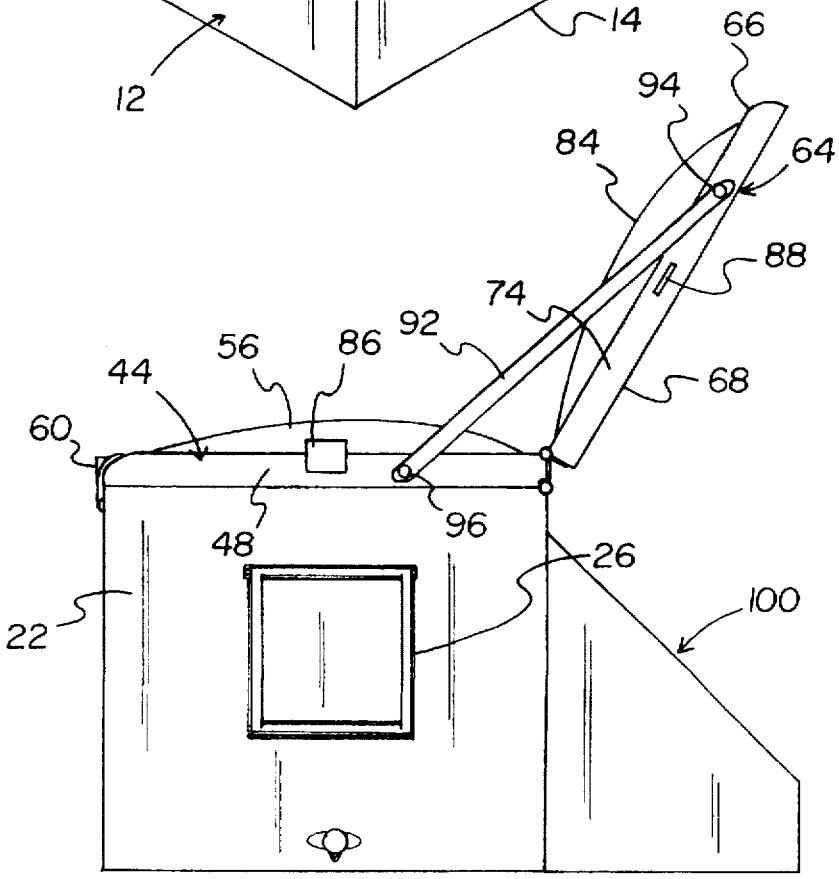
FIG. 2 is a side elevational view of the cooler and seat system of the present invention.

Also, a second lid 64, as shown in FIG. 1, is included and formed of insulated material. The second lid has a bottom portion 66 and a top portion 68, with a peripheral wall 72 therebetween. The peripheral wall forms a pair of second side walls 74 and 76, with a second rear wall 78 and a second front wall 80 therebetween. The second rear wall, as shown in FIG. 3 is hingedly coupled to the first rear wall 52 of the first lid 38 for selective coupling of the two lids with the hinge allowing rotation of the second lid about the first lid. The bottom portion 66, as seen in FIG. 2, of the second lid has a cushion member 84 fixedly attached. The cushion member of the first lid and the cushion member of the second lid are both covered with a stain proof vinyl.

Figure 5:
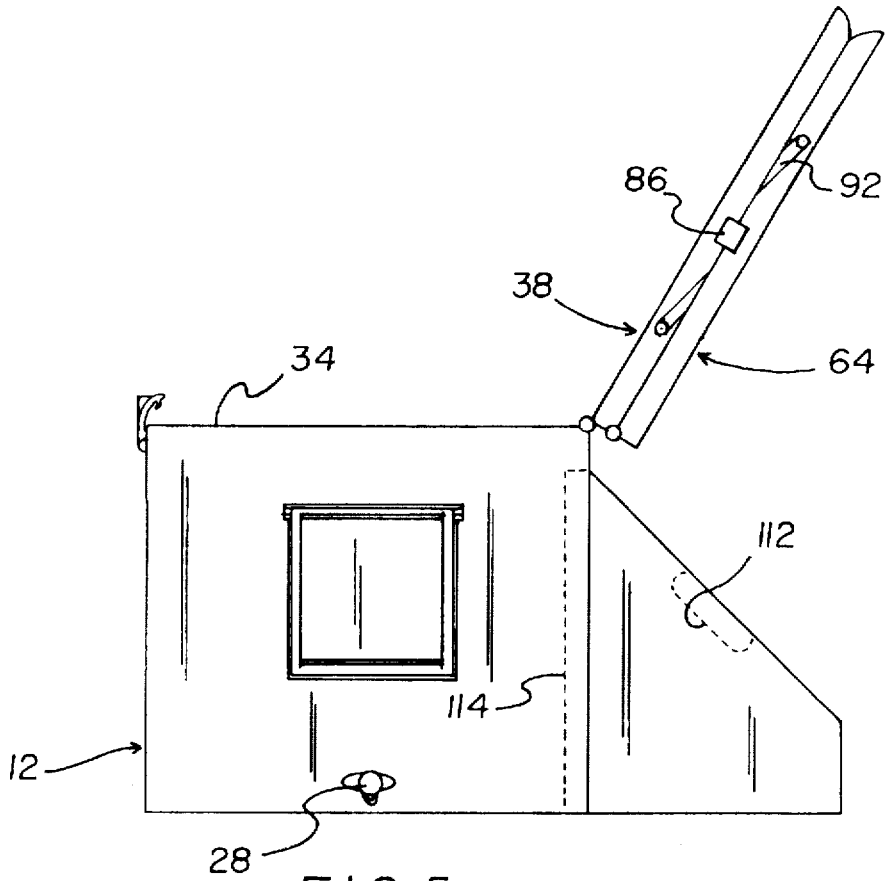
FIG. 5 is a side elevational view of the present invention in an operable configuration.

Additionally, the second lid is capable of coupling with the first lid, as depicted in FIG. 5. The lids may couple when the first lid is rotated for opening the insulated container, or when the second lid is rotated to rest against the first lid in the closed orientation. In both instances the bottom portion of the second lid is flush with the top portion of the first lid and the first and second lid are placed in a juxtapose orientation. The first lid is equipped with a clamp 86 on each of the first pair of side walls, and the second lid is equipped with receiving slots 88 on each of the pair of side walls. The clamps of the first lid will engage the slots of the second lid to secure the lids in the juxtapose orientation. The first lid, when coupled with the second lid, is capable of forming a seat, as seen in FIGS. 1 and 2, with the first lid functioning as the bottom and the second lid functioning as the back rest.

Included are a pair of anti-extension straps 92. Each is flexible and has a first end 94 coupled to the first lid and a second end 96 coupled to the second lid. As depicted in FIG. 1, the pair of anti-extension straps support the second lid in an upright position, when the first lid is flush with the upper peripheral edge of the insulated container.

Lastly, a pair of supports 100 are provided. Each support has a back end edge 102 and a front end edge 104 with a top 106 and bottom edge 108 therebetween. As shown in FIG. 3, the back end edge is hingedly coupled with the rear wall 16 of the insulated container. Each support has a concave handle 112 adjacent the top edge. The pair of supports are rotatable from a closed position, to an open position, along the rear wall of the insulated container 12. The rear wall has a pair of recesses 114, as shown in FIG. 3. Each recess is shaped so as to receive an applicable support when the support are closed. A handle clearance 116 is carved out in each recess. The handle clearance allows the user to reach into the concave handle of each of the supports to open the respective support. The pair of supports, when in an open position, are capable of balancing the insulated container when a person is seated on the first lid and resting against the second lid.

The present invention cooler and seat system is an insulated cooler chest that is structured to serve as a chair with a backrest. The invention has a dual lid system the uses a first lid at the seat the second lid as the backrest. Each lid has a cushion to provide comfort. Attached to the back of the cooler/insulated container are a pair of supports. The supports function as anti-tip supports that prevent the insulated container from tipping over while a person is seated. The pair of supports are easily folded against the rear wall of the container for storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved cooler and seat system for use as a seat while keeping foods cool comprising in combination:

an insulated container having a rectangular bottom member with a rectangular rear wall, a rectangular front wall and a pair of side walls extending upwardly therefrom, the pair of side walls forming a first side wall and a second side wall integral with and perpendicular the rear and front walls, each side wall having a handle rotatable coupled thereto, the second side wall having a drain passing therethrough, the drain being a push and pull plug capable of opening and closing for the release of liquid within the container, the insulated container having an upper peripheral edge therearound and integrally with the walls thereof, the insulated container having interior walls being integral with the upper peripheral edge;

a first lid formed of insulated material having bottom portion and a top portion with a peripheral wall therebetween, the peripheral wall forming a pair of first side walls with a first rear wall and a first front wall therebetween, the first rear side wall being hingedly coupled to the rear wall of the insulated container for selective opening and closing of the insulated container, the top portion of the first lid having a cushion member fixedly attached thereto, the bottom portion of the first lid being flush with the upper peripheral edge of the insulated container when parallel with the insulated container for closure;

a clasp being attached to the rectangular front wall of the insulated container, the clasp releasably locking the first lid firmly to the insulated container when the first lid being flush with the upper peripheral edge of the container, the clasp snap coupling with the first front wall of the peripheral wall of the first lid;

a second lid formed of insulated material having a bottom portion and a top portion with a peripheral wall therebetween, the peripheral wall forming a pair of second side walls with a second rear wall and a second front wall therebetween, each of the pair of second side walls having a receiving slot, the second rear wall being hingedly coupled to the first rear wall of the first lid for selective rotation of the second lid thereabout, the bottom portion of the second lid having a cushion member fixedly attached thereto, the second lid being capable of coupling with the first lid when the first lid is rotated for opening the insulated container, the bottom portion of the second lid being flush with the top portion of the first lid when the first and second lid being in a juxtapose orientation, the first lid when coupled with the second lid being capable of forming a seat with the first lid functioning as a bottom for the seat and the second lid functioning as a back rest for the seat;

a pair of clamps with one clamp each being fixed attached to one of the first pair of side walls of the first lid, each of the pair of clamps releasably engages one of the receiving slots of the second lid when the first lid and second lid being in the juxtapose orientation;

a pair of anti-extension straps with each having a first end coupled to the first lid and a second end coupled to the second lid, the pair of anti-extension straps supporting the second lid in an upright position when the first lid being flush with the upper peripheral edge of the insulated container; and a pair of supports with each having a back end edge and a front end edge with a top and bottom edge therebetween, the back end edge being hingedly coupled with the rear wall of the insulated container, each support having a concave handle adjacent the top edge, the pair of supports being rotatable from a closed position to an open position along the rear wall of the insulated container, the rear wall of the insulated container having a pair of recesses being sized for receiving an applicable support when the support being closed and a handle clearance being carved out within each recess, the pair of supports when in an open position being capable of balancing the insulated container when a person being seated on the first lid and resting against the second lid.

* * * * *